US008911607B2

(12) United States Patent
Kruglick

(10) Patent No.: US 8,911,607 B2
(45) Date of Patent: Dec. 16, 2014

(54) ELECTRO-DEPOSITION OF NANO-PATTERNS

(75) Inventor: Ezekiel Kruglick, Poway, CA (US)

(73) Assignee: Empire Technology Development LLC, Wilmington, DE (US)

( * ) Notice: Subject to any disclaimer, the term of this patent is extended or adjusted under 35 U.S.C. 154(b) by 903 days.

(21) Appl. No.: 12/512,823

(22) Filed: Jul. 30, 2009

(65) Prior Publication Data

US 2011/0024300 A1 Feb. 3, 2011

(51) Int. Cl.
*C25D 17/12* (2006.01)
*C25D 5/02* (2006.01)
*C25D 5/18* (2006.01)

(52) U.S. Cl.
CPC *C25D 5/02* (2013.01); *C25D 17/12* (2013.01); *C25D 5/18* (2013.01)
USPC ..... 205/118; 205/103; 205/107; 204/280

(58) Field of Classification Search
CPC ..... C25D 17/12; C25D 5/02; C25D 5/18
USPC ..... 205/95, 118, 134, 136
See application file for complete search history.

(56) References Cited

U.S. PATENT DOCUMENTS

| | | | | |
|---|---|---|---|---|
| 3,642,597 | A * | 2/1972 | Sheldon | 438/460 |
| 5,948,233 | A * | 9/1999 | De Samber et al. | 205/122 |
| 6,896,783 | B2 * | 5/2005 | Schunk et al. | 205/81 |
| 7,204,771 | B2 | 4/2007 | Gu et al. | |
| 7,252,749 | B2 | 8/2007 | Zhou et al. | |
| 7,745,228 | B2 | 6/2010 | Schwind et al. | |
| 2002/0046953 | A1 * | 4/2002 | Lee et al. | 205/104 |
| 2004/0007471 | A1 * | 1/2004 | Phu | 205/122 |
| 2006/0249391 | A1 * | 11/2006 | Jin | 205/118 |

FOREIGN PATENT DOCUMENTS

| | | |
|---|---|---|
| JP | 57-048755 | 9/1983 |
| JP | 58-164799 A | 9/1983 |

OTHER PUBLICATIONS

Wang, K.; Niu, L.; Zong, Z.; Zhang, M.; Wang, C.; Shi, X.; Men, Y.; Zou, G. Direct Electrodeposition of Copper Ladder Structures on a Silicon Substrate. Crystal Growth and Design. 2008, vol. 8, No. 2, p. 442-445.*

Wang, M.; Zhong, S.; Yin, X-B.; Zhu, J-M.; Peng, R-W.; Wang, Y.; Zhang, K-Q.; Ming, N-B.: Nanostructured Copper Filaments in Electrochemical Deposition. Physical Review Letters, 2001, 86 (17), 3827-3830.*

(Continued)

*Primary Examiner* — Brian W Cohen
(74) *Attorney, Agent, or Firm* — Dorsey & Whitney LLP

(57) ABSTRACT

The present disclosure generally relates to techniques for electro-depositing nano-patterns. More specifically, systems and methods for fabricating periodic structures in complex nano-patterns are described. An electrical signal may be applied to one or more electrodes that are positioned about a surface of a substrate. The periodicity of the deposited pattern may be influenced by one or more parameters associated with an applied electrical signal, including one or more of frequency, amplitude, period, duty cycle, etc. The weight of each deposited line on the substrate may be influenced by the described parameters, and the shape of the pattern may be influenced by the number, shape, and position of electrodes.

25 Claims, 6 Drawing Sheets

(56) References Cited

OTHER PUBLICATIONS

Wu, Z.; Bao, Y-J.; Yu, G-W.; Wang, M.; Peng, R-W.; Fleury, V.; Hao, X-P.; Ming, N-b. Characterization of periodically nanostructured copper filaments self-organized by electrodeposition. J. Phys. Condens. Matter, 18, 2006, 5425-5434.*

Schultze, J. W. et al., "Principles of Electrochemical Micro- and Nano-System Technologies", Electrochimica Acta, 2001, pp. 3-21, vol. 47.

Zong, Z et al., "Potential-Induced Copper Periodic Micro-/Nanostructures by Electrodeposition on Silicon Substrate", Nanotechnology, 2008, vol. 19, No. 31.

"English Translation of Korean Office Action received in KR 2010-0019925 dated Aug. 11, 2012".

Wang, Ke et al., "Direct Electrodeposition of Copper Ladder Structures on a Silicon Substrate", Crystal Growth & Design 2008, Published Dec. 29, 2007, vol. 8, No. 2, 442-445.

* cited by examiner

ELECTRO-DEPOSITION OF NANO-PATTERNS

BACKGROUND

Thinly spaced electrical wires are useful in a variety of applications such as resonator construction, optics, or opto-electronics. In resonator construction, the wires may be useful for thin film bulk acoustic resonators (FBAR or TFBAR). In optics, the wires may be used to dope guides. In opto-electronics, electrode arrays of such wires may be provided on a piezo film and used for launching plasmons or other controlled excitons for optical modulation.

Commonly, to electro-plate nanoscale metal gratings, such as thinly spaced electrical wires, an optical mask is used. More specifically, a thin layer of metal is electro-deposited and the wires are etched using an optical mask. Such optical masks may be expensive. To electro-plate directly, the wires are commonly provided as thin longitudinally spaced wires without complex patterns. Further, the method for such electro-plating commonly uses spinning of photoresist, cleaning, baking, or other support steps.

BRIEF DESCRIPTION OF THE FIGURES

The foregoing and other features of the present disclosure will become more fully apparent from the following description and appended claims, taken in conjunction with the accompanying drawings. Understanding that these drawings depict only several examples in accordance with the disclosure and are, therefore, not to be considered limiting of its scope, the disclosure will be described with additional specificity and detail through use of the accompanying drawings, in which:

DETAILED DESCRIPTION

Figure 1:
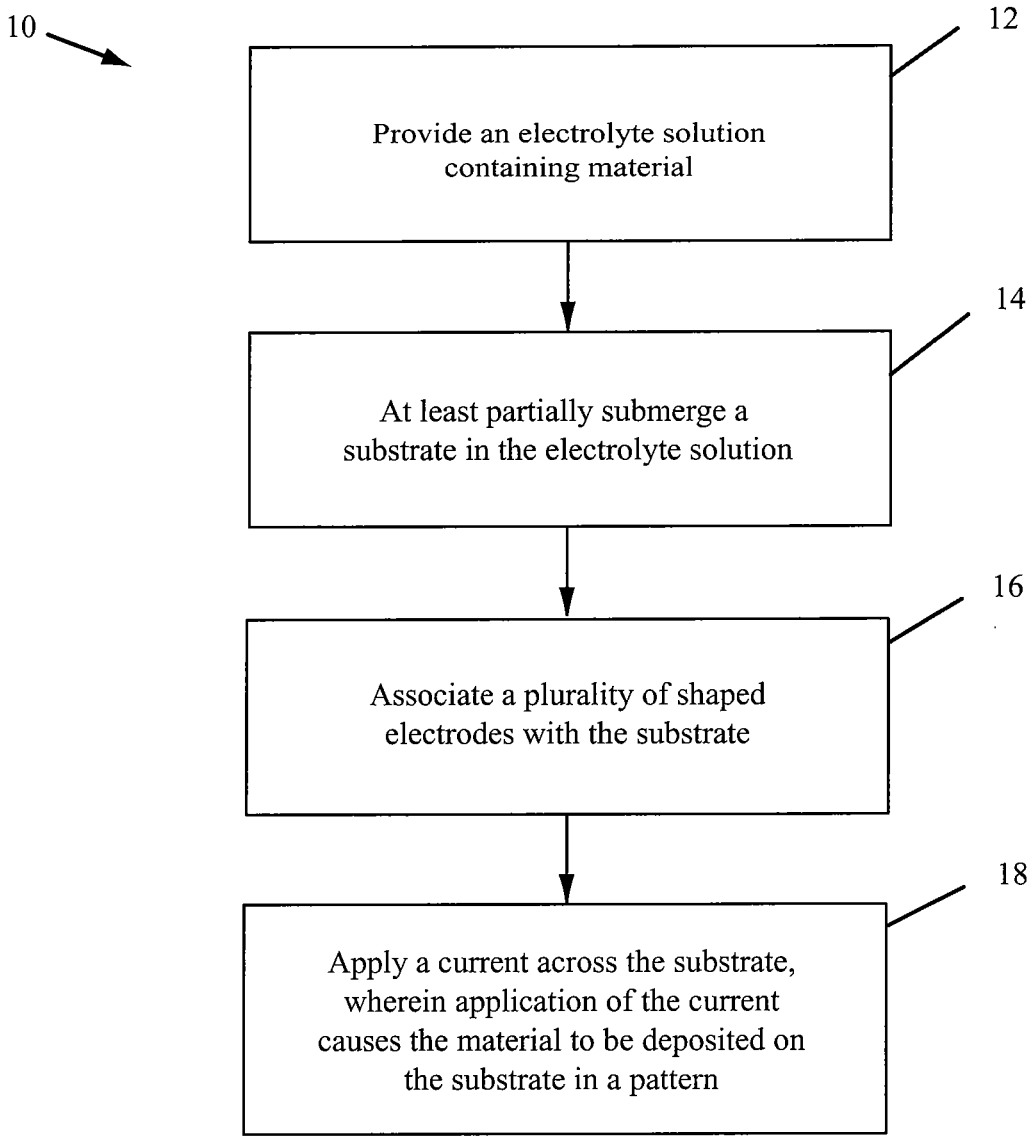
FIG. 1 illustrates a method of electro-deposition of gratings on a substrate in accordance with some examples.

In examples described herein, the following reference numerals are used. A method for electro-depositing nano-patterns 10 may include one or more of operations 12, 14, 16 and 18. A system for electro-depositing nano-patterns 30 may include one or more of electrodes 32, 32*a*, 32*b*, a power supply 34, a tank 36, an electrolyte solution 38, a processor 65, a coupling of the power supply to the electrode 60, a coupling of the processor to the power supply 67, a substrate 40; an area of electrode placement 42; and/or equi-potential lines 44. An electrode array 50 may comprise a plurality of electrodes 52*a*-52*f*. A process flow of a method for electro-depositing nano-patterns may include one or more of a direction of flow from the power supply to the electrode 61, a direction of process flow from the electrode across the substrate 63, electro-deposition lines 64, and/or a direction of electro-deposition 66.

In the following detailed description, reference is made to the accompanying drawings, which form a part hereof. In the drawings, similar symbols typically identify similar components, unless context dictates otherwise. The illustrative examples described in the detailed description, drawings, and claims are not meant to be limiting. Other examples may be utilized, and other changes may be made, without departing from the spirit or scope of the subject matter presented herein. It will be readily understood that the aspects of the present disclosure, as generally described herein, and illustrated in the figures, may be arranged, substituted, combined, separated, and designed in a wide variety of different configurations, all of which are explicitly and implicitly contemplated herein.

This disclosure is drawn, inter alia, to methods, apparatus, computer programs and systems generally related to electro-plating nano-patterns and, more specifically, fabricating periodic structures in complex nano- and micropatterns. Techniques are described for fabricating complex nano- and micropatterns of periodic structures on a substrate using multiple and/or shaped electrodes are provided. In some examples, nanoscale metal gratings such as conductive materials (e.g., nanoscale copper wires) may be patterned on a silicon substrate. Accordingly, various methods and systems for electro-plating nano-patterns in complex shapes without using an optical mask are generally disclosed. While the disclosure may make specific reference to specific complex shapes of nanoscale conductive patterns and nanoscale metal gratings, it is to be appreciated that the systems and methods disclosed herein may be used to electro-plate a variety of materials in nano- and micropatterns and for a variety of applications.

Materials may be electro-deposited on a substrate relatively simply and effectively. In some examples, constant direct current may be used to plate a thin layer of plating material on a substrate. In thin layer cells, electro-deposition of a metal may produce aggregates with irregular morphologies, including nanowires, thin metals, dendrites, etc. Generally, a nanowire is a nanostructure, with the diameter of the order of a nanometer ($10^{-9}$ meters). Alternatively, nanowires may be considered as structures that have a lateral size constrained to tens of nanometers or less and an unconstrained longitudinal size. Variously, nanowires may be metallic (e.g., Ni, Pt, Au), semiconducting (e.g., Si, InP, GaN, etc.), and insulating (e.g., $SiO_2$, $TiO_2$). In some examples, a metal material may be deposited and then used to pattern layers. Nanowires may be used in computing devices such as small circuits, in resonator construction, optics, opto-electronics, and patterning of wave guides. In some applications, such as waveguides, it may be useful to form the nanostructure in complex patterns, including any combination of discontinuous of continuous shapes such as straight lines, curved lines, chamfered bends, orthogonal bends, curvilinear bends, round shapes, elliptical shapes, spiral shapes, and other general polygonal patterns.

There are many factors that may influence growth morphology of nanostructures on a substrate. For example, growth morphology may be influenced by the frequency of applied current signal, by varying the frequency of the applied current signal, by using multiple electrodes, and/or by using shaped electrodes. The frequency of the applied current may determine periodicity of the lines. Thus, a particular frequency may result in a particular periodicity. Varying the frequency during deposition may result in a varied periodicity of the lines. Alternatively, the frequency of the applied current signal may be kept constant and selected for a specific periodicity. Accordingly, in some implementations, instead of a applying a constant plating current, such as a DC plating current or other current applied continuously over time, a pulsed current may be used that locally depletes ions in an electro-plating solution. In various examples, the pulsed current may be an alternating current signal with an associated pulse frequency. Generally, the frequency of the applied potential may be varied to control the pattern of electro-deposition. In specific examples, a potential of semi-sine or sine wave may be applied with the frequency at a given selected frequency (for a single periodicity of lines) or with the frequency varied (for a varied periodicity of lines). In alternative examples, the pulsed current may be any current signal having a substantially sine wave shape, may be a sine wave signal that is GATED on and off, may be a DC current signal that is pulsed on and off. Such current may achieve narrowly spaced wires on the substrate. In some further implementations, shaped electrodes, may be used to influence the shape of the wires on the substrate. Accordingly, in some implementations, shaped electrodes and pulsed currents may be used to provide narrowly spaced wires in complex shapes on a substrate. In various examples provided herein, more than one electrode may be used (such as two to ten or more electrodes), polarities may be alternated between electrodes, or other factors may be varied to result in complex shaped grids.

Electro-plating may use electrical current to reduce cations of a desired material from a solution and deposit a thin layer of material, such as a metal, on a substrate, such as a conductive object. The process used in electro-plating may be referred to as electro-deposition. In order to achieve patterns in the past, materials have been electro-plated and then etched using an optical mask. In contrast to such etching, in accordance with various examples provided herein, the materials may be deposited in a complex pattern.

In accordance with various implementations described herein, a shaped electrode or a shaped electrode set may be used to form nano- and microscale patterns having complex morphologies. For example, patterns may be formed that are chirped, curved, or other. In accordance with some examples, non-straight patterns (such as a curvilinear pattern or a jagged pattern) or nanofeatures (such as nanoscale metal lines) may be formed via electro-plating.

FIG. 1 illustrates a method 10 of electro-deposition of gratings on a substrate in accordance with at least some examples of the present disclosure. Electro-deposition is an electrochemical process by which a plating material, such as metal or other material, may be deposited on a substrate by passing a current through an electrolyte solution containing the plating material. As shown, an electrolyte solution containing a material may be provided at operation 12, a substrate may be at least partially submerged in the electrolyte solution at operation 14, a plurality of shaped electrodes may be associated with the substrate at operation 16, and a current may be applied across the substrate, wherein application of the current may cause the material to be deposited on the substrate in a pattern at operation 18. The current may be applied at a frequency selected for periodicity of the pattern.

More specifically, an electrolyte solution may be provided containing the material to be deposited. The electrolyte solution may be provided in a tank suitable for receiving the substrate. The substrate may be placed in the electrolyte solution containing the material to be deposited. The substrate may be fully or partially submerged. The electrode(s) may be associated with the substrate, such as by contacting the electrodes to the substrate, and current is applied.

In some examples, the substrate may act as the cathode. As the current is applied, positive metal ions from the solution may be deposited on the substrate. The material may be deposited in a periodic pattern, such as a grating pattern, by applying the current in a frequency, such as by applying a potential of semi-sine wave with a selected frequency. In alternative examples, other wave patterns may be used (e.g., pulsed signals, etc). Further, the frequency (or period) of the applied current may be varied during deposition. Generally, the applied wave, such as the semi-sine wave with a selected frequency, depletes some areas and provides a steady potential at others which may result in grating lines across equi-potentials.

Periodicity of the lines of deposition may correspond with the frequency of the applied voltage with higher frequency having a narrower width growing pattern. The shape of the electrodes and the position of the electrodes may be selected for specific equi-potentials such that the grating lines are complex and predictable. The grating lines thus may be deposited along the equi-potential lines in positions corresponding to the frequency of the applied voltage. In various examples, the frequency may range from 0.4 to 1.2 Hz. In one example, the frequency may be 0.8 Hz.

Generally, the weight of a substance deposited is proportional to the amount of current passed through the tank. Accordingly, higher levels of current may lead to heavier depositions of material. In some examples, the anode may be a sacrificial anode adapted to supply replenishment of deposited ions from an electrolyte solution. In other examples, the anode may be formed from a non-consumable material and the solution may be replenished.

In some examples, the substrate may be prepared to enhance suitability for electro-deposition. For example, the substrate may be cleaned, may be coated with a hydrophilic coating, may be coated with a conductive coating such as gold, coated with an electro-plating seed layer, or otherwise prepared. Further, the substrate may be sized and shaped for final use prior to or after electro-deposition. Thus, in some examples, the substrate may be cut or subdivided into chip sizes before electro-deposition of the material in complex patterns. In other examples, the substrate may be provided in a monolithic piece, material may be electro-deposited in complex patterns thereon, and the substrate may be cut or subdivided into sizes for use thereafter.

Accordingly, the shape of the electrodes and the position of electrodes (including number of electrodes) may influence the shape of the pattern while the frequency of the applied signal (e.g., current or voltage or standing wave) may influence periodicity of the pattern, and the level of applied signal (e.g., magnitude of the current, voltage or standing wave) may influence the deposition level of the material. Thus, in accordance with various examples, different numbers of electrodes may be used, different shapes of electrodes may be used, different frequencies may be used, and/or different current levels may be used. One or more of these factors may be selected based on desired pattern of deposition.

Generally, multi-frequency resonators may be made on a piezoelectric material. In some examples, bulk acoustic resonators and/or bulk acoustic wave resonators may be made. If the applied signal has a frequency that matches with the frequency of the piezoelectric material, a good resonance may be achieved. Alternatively, arrays of different frequency signals (e.g., a spectrum of signals) or complex resonators may be generated. Such devices may be made using electrodes in different patterns such as different spacing of lines deposited using the plating described. For example, the frequency may be held at approximately 0.4 Hz for a first period of time, then held at approximately 0.8 Hz for a second period of time, then held at approximately 1.2 Hz for a third period of time. The periodicity of deposited lines thus may be varied, with one periodicity resulting at 0.4 Hz, another periodicity resulting at 0.8 Hz, and another periodicity resulting at 1.2 Hz. In some examples, one electrode may be held at ground and the other electrode may apply a pulsed signal, such as an AC signal that may be gated on/off, or a DC signal that may be pulsed on/off. Generally, applied current may be very low such as on the order of milli-amperes or nano-amperes. Nano-amperes may be used when the substrate is approximately chip sized and milli-amperes may be used when the substrate is approximately wafer-sized, for example.

Figure 2A:
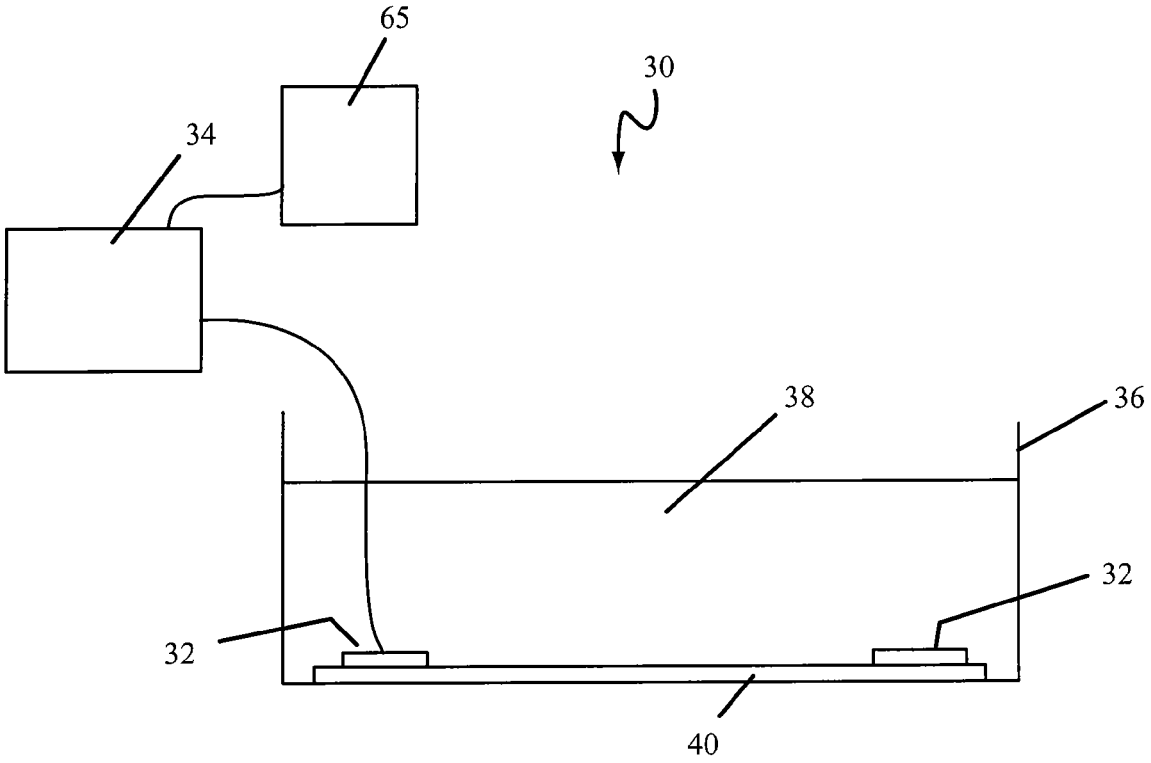
FIG. 2*a* illustrates an electro-plating system in accordance with some examples.

FIG. 2*a* illustrates an electro-plating system in accordance with at least some examples of the present disclosure. As shown, the electro-plating system 30 may include one or more electrodes 32 (including, for example, an anode and a cathode), a signal generator or power source 34, a tank 36 (also referred to as a plating bath), an electrolyte solution 38, and a processor 65. The tank 36 may be made of a generally non-metallic material, such as a plastic material. The electrolyte solution 38 may be provided in the tank 36 and may contain the metal material to be plated in an ionic form. For example, for plating copper, the electrolyte solution 38 may comprise analytical reagent $CuSO_4$ and Millipore water. In one implementation, the concentration of the $CuSO_4$ electrolyte may be approximately 0.05 M and the pH of the electrolyte solution may be approximately 2.4. The signal generator or power source 34 may be configured to apply an electrical signal or current to at least one of the one or more electrodes 32. The power source 34 may be arranged to apply the electrical signal as a time varying signal between the one or more electrodes 32. Such time varying signal may correspond to a continuously varying signal, a periodically varying signal, or a superposition of both. Alternatively, such time varying signal may correspond to a sine wave signal, a pulsed signal, or a superposition of both. A frequency modulator (not shown) or a pulse modulator (not shown) may be associated with the signal generator or power source 34 such that a frequency (and/or a pulse rate or pulse width) associated with the applied electrical signal may be adjusted. One or more devices for controlling temperature may be provided (not shown), such as a Peltier element and temperature selector. By reducing temperature, the electrolyte solution 38 may be solidified.

For depositing a material, a substrate 40 may be placed in the electrolyte solution 38. It is to be appreciated that the orientation of the electrodes with respect to the substrate may be any suitable contact orientation, including, for example, laying of the electrodes on the substrate. Generally, the shaped electrodes 32 may be shaped and disposed about the surface of the substrate to provide a morphology to a deposited pattern that is different from a straight line pattern.

In some examples, a system for electro-plating a pattern on a surface of a substrate may include a first shaped electrode and a second shaped electrode, such as electrodes 32 of FIG. 2*a*. The surface of the substrate may be configured to receive deposited material. The first shaped electrode may be positioned about the surface of the substrate at a first location and may be configured to receive an electrical signal. The second shaped electrode may be positioned about the surface of the substrate at a second location that is different from the first location. The first shaped electrode and the second shaped electrode may be configured such that when the electrical signal is applied to the first shaped electrode, a conductive path may be formed between the first shaped electrode and the second shaped electrode such that material may be deposited on the surface of the substrate according to a desired pattern. In some examples, a plurality of first shaped electrodes and/or a plurality of second shaped electrodes may be provided.

In various examples, the power source/signal generator, the frequency modulator (not shown), and/or the pulse modulator (not shown) may be configured to modify one or more of parameters associated with the electrical signal such as an amplitude of the generated waveform, a pulse duration (or width), a pulse period (or frequency), a duty cycle, and/or an exposure time, in addition to any other waveform parameters.

In some examples, systems and methods as described herein may further include a computing system (not shown). The computer system may be arranged to operate as a controller for one or more of the described processes, and/or the computer system may be adapted to configure one or more of the other devices used a described process. For example, the computer system may be adapted to drive the signal generator or power source 34 to adjust or control one or more of a signal level, a frequency, a period, a pulse duration, a duty cycle, an exposure time, or some other characteristic of the electrical signal applied to one or more of the electrodes 32. A varied frequency may in some examples increase evenness of deposition. In one particular example, a processor 65 may be adapted to control a frequency and/or a signal level of a current signal provided by the signal generator or power source 34. In alternative examples, a semi-sine type of waveform (e.g. an applied since wave voltage) may be programmed using a signal generator and/or an oscilloscope.

Figure 2B:
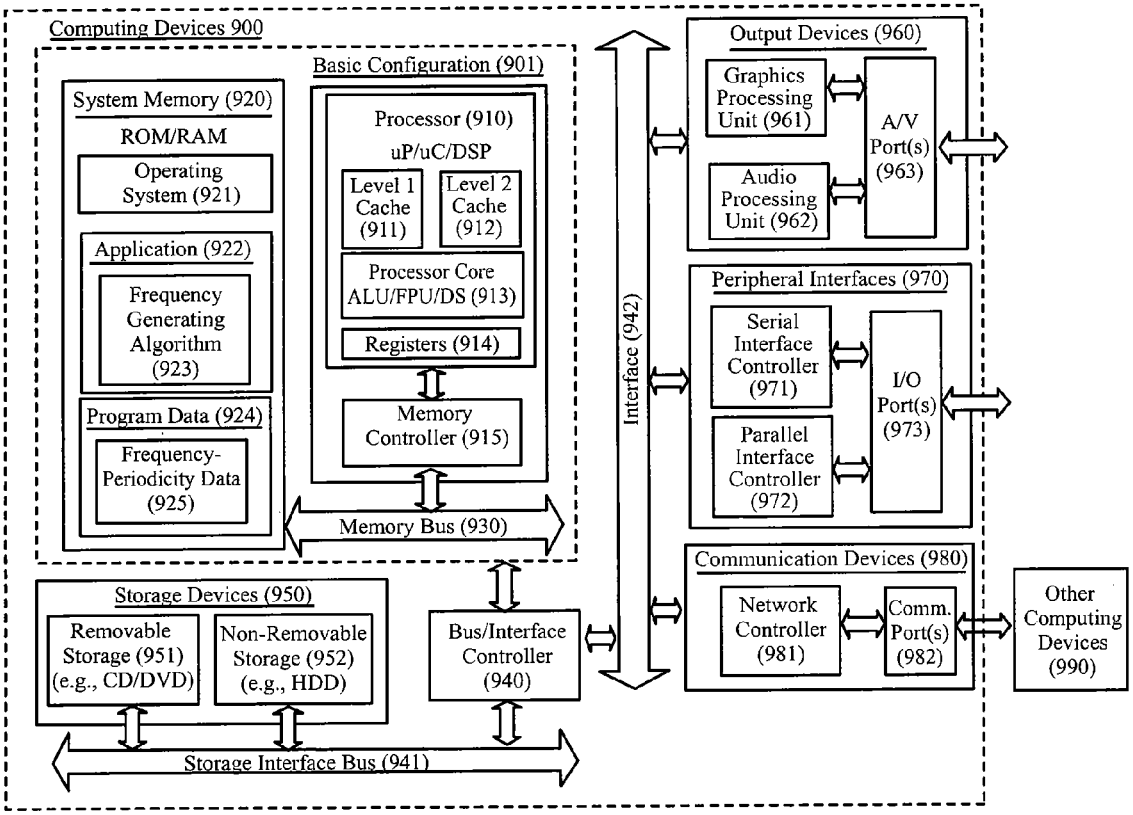
FIG. 2*b* is a block diagram illustrating an example computing device 900 that is arranged for electro-deposition in accordance with some examples.

FIG. 2*b* is a block diagram illustrating an example computing device 900 that is arranged for electro-deposition in accordance with at least some examples of the present disclosure. In a very basic configuration 901, computing device 900 typically includes one or more processors 910 and system memory 920. A memory bus 930 may be used for communicating between the processor 910 and the system memory 920.

Depending on the desired configuration, processor 910 may be of any type including but not limited to a microprocessor (μP), a microcontroller (μC), a digital signal processor (DSP), or any combination thereof. Processor 910 may include one more levels of caching, such as a level one cache 911 and a level two cache 912, a processor core 913, and registers 914. An example processor core 913 may include an arithmetic logic unit (ALU), a floating point unit (FPU), a digital signal processing core (DSP Core), or any combination thereof. An example memory controller 915 may also be used with the processor 910, or in some implementations the memory controller 915 may be an internal part of the processor 910.

Depending on the desired configuration, the system memory 920 may be of any type including but not limited to volatile memory (such as RAM), non-volatile memory (such as ROM, flash memory, etc.) or any combination thereof. System memory 920 may include an operating system 921, one or more applications 922, and program data 924. Application 922 may include a frequency generating algorithm 923 that may be arranged to generate one or more frequencies for applied electrical signals. Program Data 924 may include frequency-periodicity data 925 that may be useful for determining a frequency corresponding to a specific periodicity. In some embodiments, application 922 may be arranged to operate with program data 924 on an operating system 921 such that an electrical signal with a desired frequency (and/or signal amplitude, pulse rate, etc.) may be applied to one or more electrodes in a manner consistent with one or more describes methods/processes/operations to vary or adjust the periodicity of lines of deposition. This described basic configuration is illustrated in FIG. 9 by those components within dashed line 901.

Computing device 900 may have additional features or functionality, and additional interfaces to facilitate communications between the basic configuration 901 and any required devices and interfaces. For example, a bus/interface controller 940 may be used to facilitate communications between the basic configuration 901 and one or more data storage devices 950 via a storage interface bus 941. The data storage devices 950 may be removable storage devices 951, non-removable storage devices 952, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and nonvolatile, removable and non-removable media implemented in any method or technology for storage of information, such as computer readable instructions, data structures, program modules, or other data.

System memory 920, removable storage 951 and non-removable storage 952 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 900. Any such computer storage media may be part of device 900.

Computing device 900 may also include an interface bus 942 for facilitating communication from various interface devices (e.g., output interfaces, peripheral interfaces, and communication interfaces) to the basic configuration 901 via the bus/interface controller 940. Example output devices 960 include a graphics processing unit 961 and an audio processing unit 962, which may be configured to communicate to various external devices such as a display or speakers via one or more A/V ports 963. Example peripheral interfaces 970 include a serial interface controller 971 or a parallel interface controller 972, which may be configured to communicate with external devices such as input devices (e.g., keyboard, mouse, pen, voice input device, touch input device, etc.) or other peripheral devices (e.g., printer, scanner, etc.) via one or more I/O ports 973. An example communication device 980 includes a network controller 981, which may be arranged to facilitate communications with one or more other computing devices 990 over a network communication link via one or more communication ports 982.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 900 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 900 may also be implemented as a personal computer including both laptop computer and non-laptop computer configurations.

Typically, electrodes for electro-plating have been designed for uniform and even electroplating. A single electrode is used in many prior methods, where the substrate acts as the cathode and an anode is provided as a single flat electrode. In contrast to such single flat electrode, implementations of various techniques described herein may use one or more shaped electrodes, including in some examples, a plurality of electrode pairs or a plurality of anodes. In some examples, the electrodes may be approximately 1 mm or smaller in length or diameter. Such electrodes may be machined on a small scale or may be micromachined.

Figure 3A:
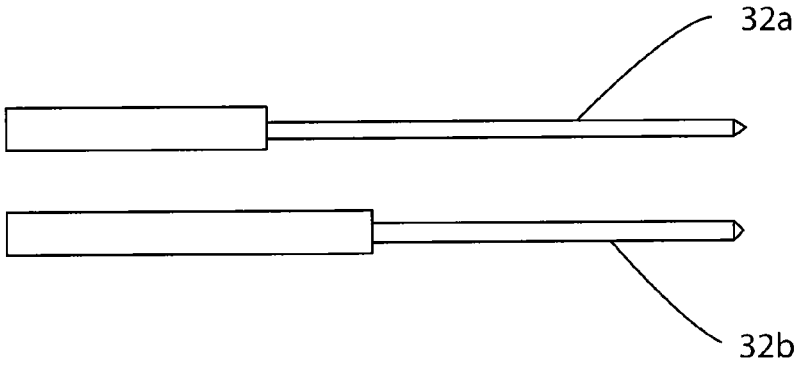
FIG. 3*a* illustrates shaped electrodes with different potential areas in accordance with some examples.
Figure 3B:
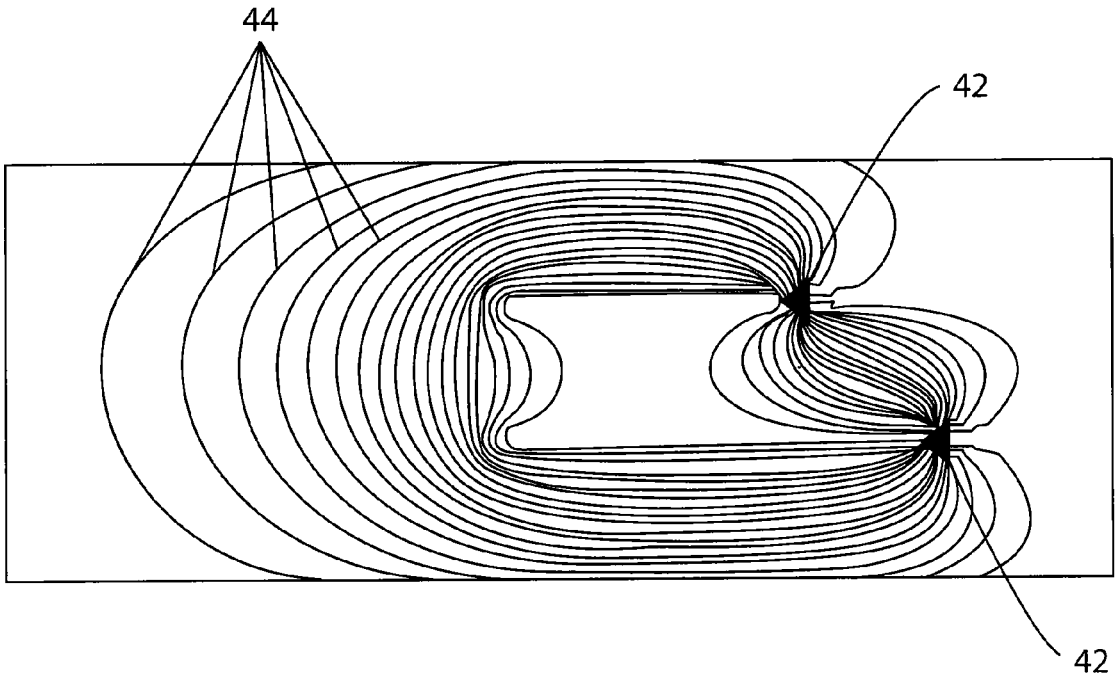
FIG. 3*b* illustrates an example pattern generated by the shaped electrodes of FIG. 3*a;*

FIG. 3*a* illustrates shaped electrodes with different potential areas in accordance with at least some examples of the present disclosure. FIG. 3*b* illustrates an example pattern generated by the shaped electrodes of FIG. 3*a*. FIG. 3*a* illustrates a first electrode 32*a* and a second electrode 32*b*. As shown, the first electrode 32*a* and the second electrode 32*b* may have different sizes and/or shapes and thus may have different areas held at different electrical potentials, DC, or varied. These may be referred to as "potential areas." Generally, providing more than one electrode may provide a plurality of points corresponding to the location of each electrode, one corresponding to each electrode, such as the points 42 shown in FIG. 3*b*. The points 42 represent nodes of the equi-potential lines. As shown in FIG. 3*a*, broad equi-potential sections are provided along the top and bottom and a complex chirped region is provided at the right. In various examples, a chirped region may refer to an area with a monotonically and smoothly varying spatial frequency. In specific examples, chirped regions may be generated at the same plating frequency at least because the shape of electrodes may cause areas of equipotential lines are crowded and areas where equipotential lines are spaced apart. FIG. 3*b* further illustrates the equi-potential areas or lines 44.

The electrodes may be formed in any suitable shape for forming desired equi-potential lines. In some examples, the shape of the electrodes may be straight lines. Alternatively, the shape of the electrodes may be half-circles with arcs. Various shapes utilized and the equi-potential lines are determined by tracing such lines in a gradient field. Following the equi-potential lines provides an indicator of deposition shape during electro-plating. Equi-potential refers to a region in space where every point in the region of space is at the same potential.

Equi-potential surfaces may be used to visualize an (n)-dimensional scalar potential function in (n−1) dimensional space. For scalar potentials, the gradient in an equi-potential region is roughly zero, since there is no change in the value of the potential. This is important in physics because the force on a body is often determined by the gradient of that force's potential function. For example, there is no significant electric field in an equi-potential region (that is, a region of constant voltage). It is to be appreciated that equipotential lines may have gradients passing through them in a direction perpendicular to the line at each point. A charged particle in such an equi-potential region experiences no significant electric force. Thus, there is no electric current between two points of equal voltage because there is no force driving the electrons.

The electrodes may be formed of any suitable material. Generally, the electrodes may be formed of a material suitable for machining and, in some examples, micro-machining. Thus, for example, the electrodes may be formed of one or more materials including nickel, copper, or graphite. Electrodes formed of a material that may be depleted by the electrolyte solution may not be suitable for reuse while electrodes formed from a material that may not be depleted by the electrolyte solution may be suitable for reuse. In alternative examples, the electrodes may be formed of a material suitable for reuse.

Any suitable material may be used as a substrate so long as it may be electro-plated upon. For example, a piezo-electric substrate such as aluminum nitrate substrate material may be used. For electronics, a thin layer of gold may be provided over the substrate. Common substrate materials for electroplating may include piezo-electric materials, silicon on insulators (SOI, such as silicon on oxides) materials, oxide materials, and polymer materials, sometimes with seed layers. The electrodes may be shaped to create a morphology in a deposited pattern that is different from a straight line pattern. Generally, the created pattern may be based on an equi-potential between the electrodes. In some examples, all of one or more provided electrodes may have the same shape and dimensions. In other examples, at least one dimension may vary between a plurality of electrodes.

Any suitable electrolyte solution may be used. Generally, the electrolyte solution contains one or more dissolved metal salts as well as other ions that permit the flow of electricity. The dissolved metal salt comprises the material to be deposited on the substrate.

Systems and methods described herein may be used for forming nano-patterns having complex shapes on a substrate. Systems and methods described herein may be used for a variety of applications including electronics, optics, and wave guides. Wave guides are commonly patterned on a silicon wafer and have complex polygon and often curved shapes. Accordingly, systems and methods such as described herein may be useful for patterning array wave guides and curved wave guide type of structures. Generally, if the patterns is kept to a thickness wherein conductivity of the deposited material is less than or roughly equal to that of the substrate, additional patterns may be generated in layers over the deposited layer using processes as described herein. Accordingly, complex shaped grids may be formed.

Figure 4:
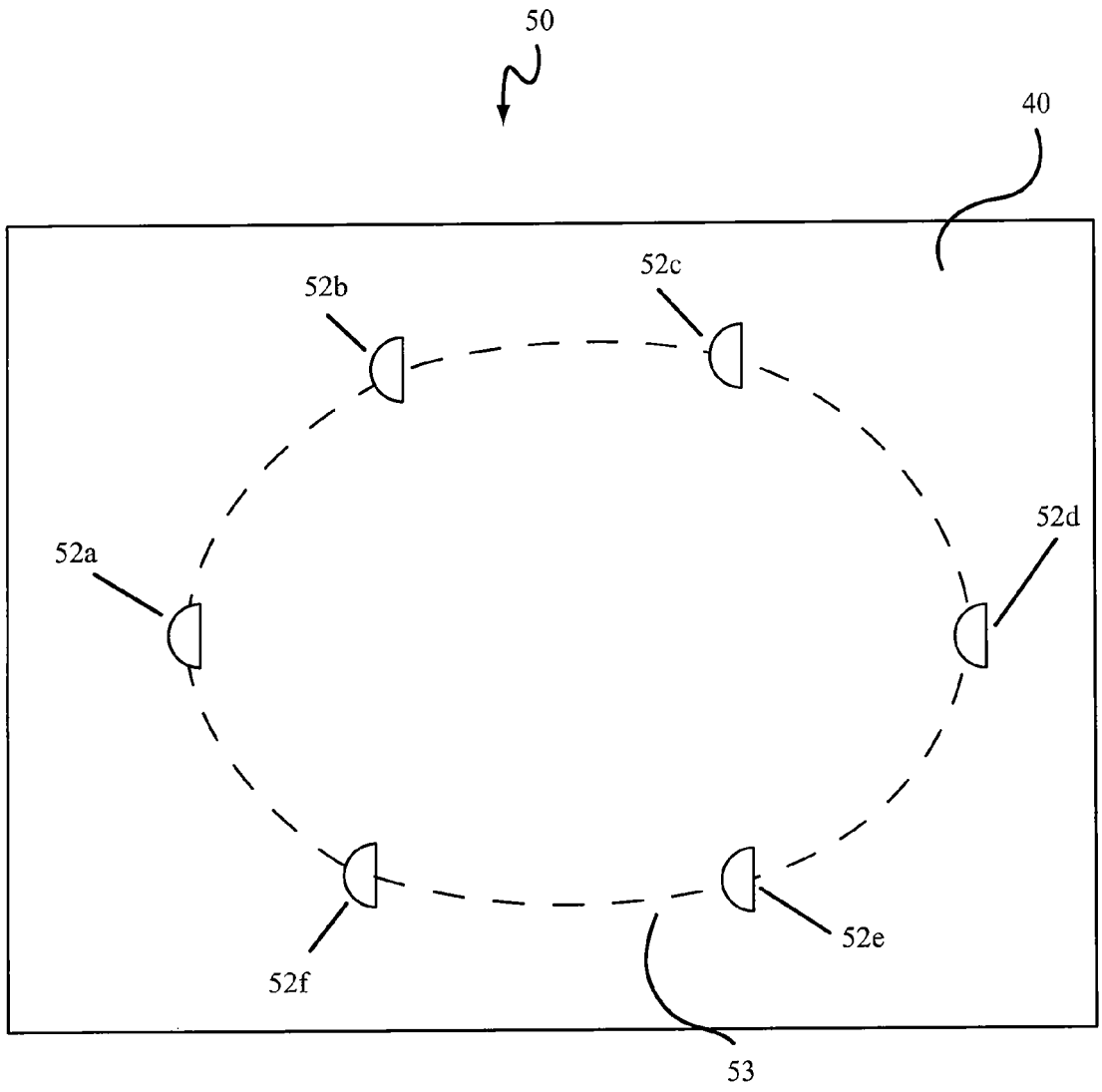
FIG. 4 depicts an electrode array for electro-depositing nano-patterns, in accordance with some examples.

FIG. 4 illustrates an example set electrode array 50 for generating a complex pattern of electro-deposition as positioned on a substrate 40, in accordance with at least some examples of the present disclosure. In the illustrated example, the electrodes 52*a*-52*f* are shaped as half-circles. It is to be appreciated that, in other examples, electrodes 52*a*-52*f* may have any suitable shape or size, including all electrodes identically shaped/sized or differently shaped/sized. As shown six electrodes 52*a*-52*f* may be positioned such that a line drawn from one electrode to the next would form a closed loop. This may be referred to herein as a generally closed loop configuration. Such a loop may be in the shape of, for example, a circle, an oval, a square, or a rectangle. In some examples, a polarity associated with the electrodes may be arranged to alternate along the loop of the configuration. For example, the first 52*a*, third 52*c*, and fifth 52*e* electrodes may have positive polarity and the second 52*b*, fourth 52*d*, and sixth 52*f* electrodes may have negative polarity. It is to be appreciated that more or fewer electrodes may be provided in such closed loop configuration and the number of electrodes may be odd or even.

Figure 5A:
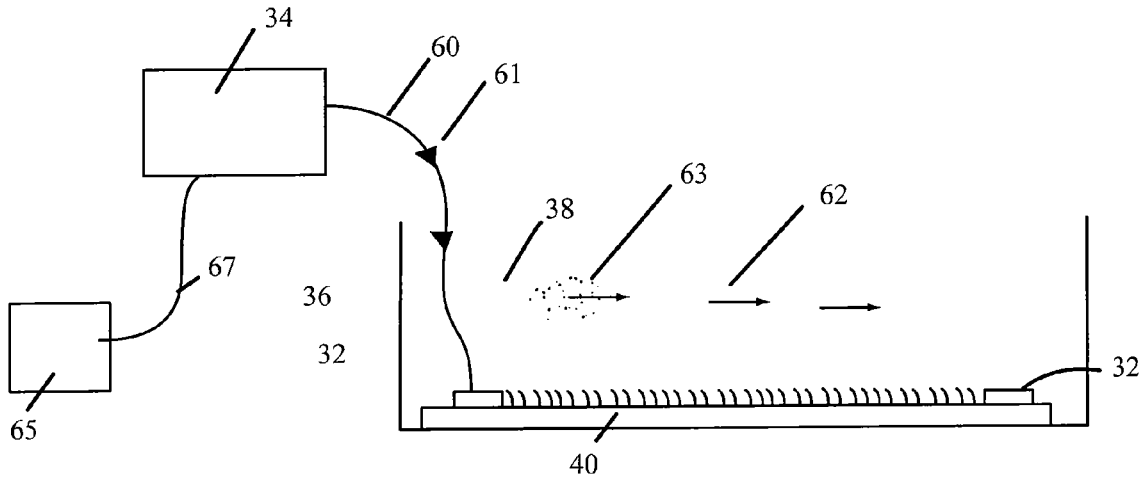
FIG. 5*a* is a diagram of process flow through a system for electro-depositing nano-patterns, in accordance with some examples.
Figure 5B:
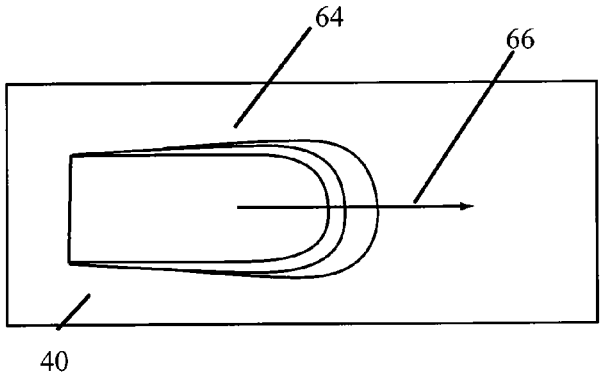
FIG. 5*b* is a diagram of process flow across a substrate through a system for electro-depositing nano-patterns, all arranged in accordance with at least some examples of the present disclosure.
Figure 2B:
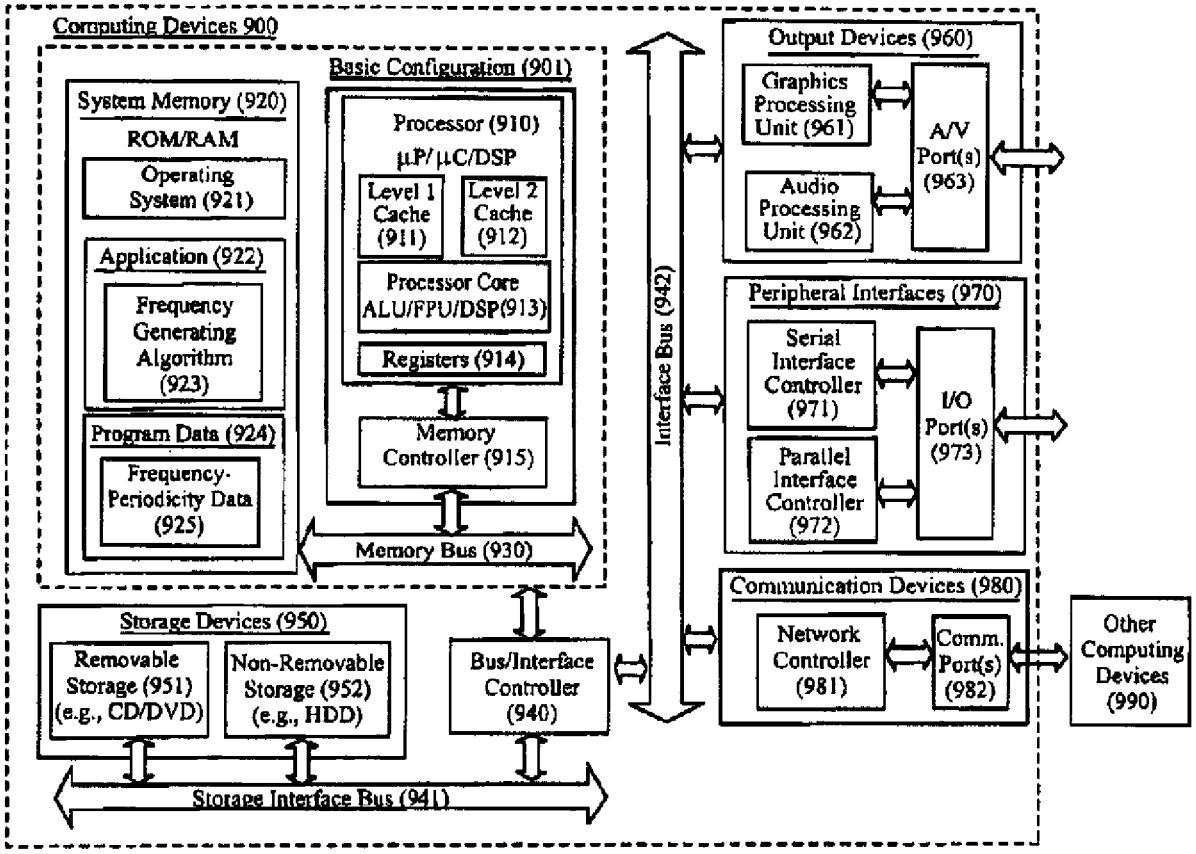

FIGS. 5*a* and 5*b* illustrates process flow of using an electrodeposition system as provided in accordance with at least some examples of the present disclosure. As shown, power is generated at the power generator 34 and passed along coupling 60 as an electrical signal in the direction of arrow 61 to an electrode 32. In some examples, the electrodes 32 may be provided as a first shaped electrode and a second shaped electrode such that when the electrical signal is received by the first shaped electrode, a conductive path may be formed between the first shaped electrode and the second shaped electrode such that the material may be deposited on the surface of the substrate according to a desired pattern. In other examples, the electrodes 32 may be provided such that an electrical signal may be applied to each of the electrodes 32. The power generator 34 may be coupled to a processor 65, where the processor 65 may be arranged to control one or more parameters associated with the electrical signal including but not limited to one or more of frequency, amplitude, pulse duration, pulse period, duty cycle, exposure time, etc. Accordingly, the processor 65 may be arranged to communicate with the power generator 34 via coupling 67. In response to the electrical signal (e.g., power, voltage, current, etc.) from the power generator 34, the electrode may apply an electrical current signal across a surface region of the substrate 40 in the direction of arrow 62. The electrical current flow between the electrodes may promote material 63 in the electrolyte solution 38 to be deposited on the substrate 40. The material may be deposited in a pattern 64 in the direction of arrow 66. The periodicity of the pattern 64 may be influenced by the variance of frequency (or other parameters) associated with the electrical signal resulting in the applied electrical current signal, where the weight of each deposited line may be influenced by the current level (e.g., amplitude) of the applied current signal, and the shape of the pattern 64 may be influenced by the number, shape, and position of electrodes 32. The substrate 40 may be held at a fixed or varying potential.

The present disclosure is not to be limited in terms of the particular examples described in this application, which are intended as illustrations of various aspects. Many modifications and variations may be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which may, of course, vary. It is also to be understood that the terminology used herein is for the purpose of describing particular examples only, and is not intended to be limiting. The foregoing describes various examples of electro-deposition of complex nano-patterns. Following are specific examples of methods and systems of electro-deposition of complex nano-patterns. These are for illustration only and are not intended to be limiting.

The present disclosure generally relates to systems and methods for electro-deposition of complex nano-patterns. In some examples, a system for electro-plating a pattern on a substrate comprises a substrate having a surface capable of receiving conductor deposition and a plurality of shaped electrodes. The plurality of shaped electrodes are associated with the surface of the substrate and are configured for coupling to a power source such that when electrical current is applied to the electrodes, a pattern is deposited. The system may include an electrolyte solution wherein the substrate is at least partially submerged in the solution. The system may include a power source having a frequency modulator.

In various implementations, the electrodes may be shaped and disposed on the surface of the substrate to provide a morphology to the pattern that is not straight. The electrodes may be reusable. At least one of the electrodes may be a sacrificial anode. The electrodes may be generally linear, may be generally half-circles, or may have other shapes. At least one dimension of the electrodes may differ between at least two of the electrodes. The electrodes may be provided in a closed loop configuration. Polarity of the electrodes may alternate between neighboring electrodes. The pattern may be based on an equi-potential of the electrodes.

In various implementations, the substrate may be a piezo material, a silicon material, an oxide material, a polymer material, or other suitable material. The substrate may include a coating selected to enhance suitability of the substrate for deposition. For example, the coating increase the conductivity of the substrate and/or may be hydrophilic. The substrate may have a pattern deposited on its surface.

In some examples, a method for electro-depositing a pattern on a substrate is provided. The pattern may include providing an electrolyte solution containing a material, at least partially submerging the substrate in the electrolyte solution, associating a plurality of shaped electrodes with the substrate, and applying a current across the substrate wherein application of the current causes the material to be deposited on the substrate in the pattern. The pattern may be based on an equi-potential of the electrodes. The frequency of the current may determine the periodicity of the pattern. In some examples, the frequency of the current may be applied in a semi-sine wave and/or may range from approximately 0.4 Hz to approximately 1.2 Hz. The number and position of the electrodes may be selected such that the pattern is not straight. The method may further include subdividing the substrate into chip sizes before or after applying a current across the substrate.

There is little distinction left between hardware and software implementations of aspects of systems; the use of hardware or software is generally (but not always, in that in certain contexts the choice between hardware and software may become significant) a design choice representing cost vs. efficiency tradeoffs. There are various vehicles by which processes and/or systems and/or other technologies described herein may be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation; or, yet again alternatively, the implementer may opt for some combination of hardware, software, and/or firmware.

The foregoing detailed description has set forth various examples of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples may be implemented, individually and/or collectively, by a wide range of hardware, software, firmware, or virtually any combination thereof. In one example, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the examples disclosed herein, in whole or in part, may be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, those skilled in the art will appreciate that the mechanisms of the subject matter described herein are capable of being distributed as a program product in a variety of forms, and that an illustrative example of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein may be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely examples, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically matable and/or physically interacting components and/or wirelessly interactable and/or wirelessly interacting components and/or logically interacting and/or logically interactable components.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range may be easily recognized as sufficiently describing and enabling the same range being broken down into at least equal halves, thirds, quarters, fifths, tenths, etc. As a non-limiting example, each range discussed herein may be readily broken down into a lower third, middle third and upper third, etc. As will also be understood by one skilled in the art all language such as "up to," "at least," "greater than," "less than," and the like include the number recited and refer to ranges which may be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. A method for electro-depositing a desired pattern on a surface of a substrate comprising:

providing a substrate in contact with an electrolyte solution containing a material for electroplating;

positioning a plurality of shaped electrodes at different locations on the surface of the substrate in a closed loop configuration, wherein a polarity associated with the plurality of electrodes is arranged to alternate along the closed loop configuration; and applying an electrical current signal to at least one of the plurality of electrodes, wherein applying an electrical current signal to the at least one electrode generates equi-potential lines and forms a conductive path along the closed loop configuration, wherein the electro-depositing occurs along the equi-potential lines resulting in a pattern extending along the equipotential lines in a plane parallel to a plane defined by the surface of the substrate, and wherein the pattern includes a curved line.

2. The method of claim 1, wherein the electrical current signal corresponds to a semi-sine wave.

3. The method of claim 2, wherein a frequency associated with the semi-sine wave ranges from approximately 0.4 Hz to approximately 1.2 Hz.

4. The method of claim 1, wherein the pattern is different from a straight line.

5. The method of claim 1, further comprising subdividing the substrate into chip sizes.

6. The method of claim 5, wherein subdividing is done before applying the electrical current signal across the surface of the substrate.

7. The method of claim 5, wherein subdividing is done after applying the electrical current signal across the surface of the substrate.

8. The method of claim 1, wherein at least two electrodes from the plurality of shaped electrodes have the same polarity.

9. The method of claim 1, wherein at least one of the plurality of electrodes is a sacrificial anode.

10. The method of claim 1, wherein applying an electrical current signal comprises forming a closed mop between the plurality of shaped electrodes.

11. The method of claim 1, wherein positioning a plurality of shaped electrodes comprises positioning a first electrode at a first location and a second electrode at as second location that is different from the first location, and wherein applying an electrical current comprises forming a conductive path between the first electrode and the second electrode.

12. The method of claim 1, wherein applying an electrical current comprises applying a time-varying signal between the plurality of shaped electrodes.

13. The method of claim 1, further comprising modulating a frequency of the electrical current signal.

14. The method of claim 1, further comprising varying one or more of amplitude of the electrical current, exposure time, pulse duration, pulse period, or duty cycle.

15. The method of claim 1, further comprising, prior to providing a substrate in contact with an electrolyte solution, preparing the substrate to enhance suitability of the surface of the substrate for electro-deposition.

16. The method of claim 1, further comprising, prior to providing a substrate in contact with the electrolyte solution, coating the substrate with one of a hydrophilic coating, a conductive coating, or an electro-plating seed layer.

17. The method of claim 1, further comprising depositing a first line having a first weight and a second line having a second weight different from the first weight.

18. The method of claim 1, wherein the electrical current signal is received by a first electrode of the plurality of electrodes.

19. The method of claim 1, wherein the electrical current signal is received by each of the plurality of electrodes.

20. The method of claim 1 further comprising replenishing deposited ions when the plurality of electrodes are mostly formed from a non-consumable material.

21. The method of claim 1, where in the plurality of electrodes are positioned such that a line drawn from one electrode to the next would form a dosed loop.

22. The method of claim 1, wherein a first, a third, and a fifth electrode have a positive polarity, and a second, a fourth, and a sixth electrode have a negative polarity.

23. The method of claim 1, wherein the closed loop configuration is one of a circle, an oval, a square, or a rectangle.

24. The method of claim 1, wherein the pattern has region with monotonically and smoothly varying frequency.

25. The method of claim 1, wherein the pattern has a chirped region.

* * * * *

UNITED STATES PATENT AND TRADEMARK OFFICE

CERTIFICATE OF CORRECTION

PATENT NO. : 8,911,607 B2
APPLICATION NO. : 12/512823
DATED : December 16, 2014
INVENTOR(S) : Kruglick It is certified that error appears in the above-identified patent and that said Letters Patent is hereby corrected as shown below:

In the Drawings

In Fig. 2B, Sheet 3 of 6, delete "uP/uC/DSP" and insert -- μP/μC/DSP --, therefor. (See Attached Sheet)

In Fig. 2B, Sheet 3 of 6, in Box "(913)", in Line 2, delete "ALU/FPU/DS" and insert -- ALU/FPU/DSP --, therefor. (See Attached Sheet)

In Fig. 2B, Sheet 3 of 6, delete "Interface (942)" and insert -- Interface Bus (942) --, therefor. (See Attached Sheet)

In the Specification

In Column 1, Line 60, delete "patterns 10" and insert -- patterns 30 --, therefor.

In Column 12, Line 17, delete "and or" and insert -- and/or --, therefor.

In the Claims

In Column 15, Line 6, in Claim 10, delete "mop" and insert -- loop --, therefor.

In Column 15, Line 10, in Claim 11, delete "at as" and insert -- at a --, therefor.

In Column 16, Line 12, in Claim 20, delete "claim 1" and insert -- claim 1, --, therefor.

In Column 16, Line 17, in Claim 21, delete "dosed" and insert -- closed --, therefor.

Signed and Sealed this
Second Day of June, 2015

Michelle K. Lee

Michelle K. Lee
*Director of the United States Patent and Trademark Office*